US006575379B1

(12) United States Patent
Wang

(10) Patent No.: US 6,575,379 B1
(45) Date of Patent: Jun. 10, 2003

(54) FRAME STRUCTURE WITH FAR INFRARED HEATING FUNCTION

(76) Inventor: Claire Wang, 3F., 200, Sin-Yi Rd., Sec. 3, Taipei (TW), 106

( * ) Notice: Subject to any disclaimer, the term of this patent is extended or adjusted under 35 U.S.C. 154(b) by 0 days.

(21) Appl. No.: 10/246,529

(22) Filed: Sep. 19, 2002

(51) Int. Cl.[7] ..... F24F 7/00
(52) U.S. Cl. ..... 237/46; 237/70
(58) Field of Search ..... 237/46, 70, 50; 126/84, 293; 165/248

(56) References Cited

U.S. PATENT DOCUMENTS 3,832,992 A * 9/1974 Trombe et al. ..... 126/628
5,716,207 A * 2/1998 Mishina et al. ..... 432/253

* cited by examiner

*Primary Examiner*—Derek Boles
(74) *Attorney, Agent, or Firm*—Dennison, Schultz & Dougherty

(57) ABSTRACT

The present invention discloses a frame structure with far infrared heating function, wherein a far infrared electro-thermal plate is mounted on the back of the canvas, and an energy chamber extends backwards from the back of the frame, and the energy chamber has a plurality of ventilation holes on its top and bottom rims to enable the air convection through the ventilation holes under the drive of heat generated from the electro-thermal plate and accumulated in the energy chamber to heat the room. Thus the fresco has double effects of both indoor decoration and electro-thermal heating.

2 Claims, 2 Drawing Sheets

FRAME STRUCTURE WITH FAR INFRARED HEATING FUNCTION

FIELD OF THE INVENTION

The present invention relates to a frame structure, more particularly to a frame structure with far infrared heating function.

BACKGROUND OF THE INVENTION

Investigations show that infrared rays belong to one of electromagnetic waves, and any object with its temperature above absolute zero degree (−273 ° C. ) radiates infrared rays. The wavelength of infrared rays is about between 7.75 and 1,000 microns. Infrared rays can be classified into near infrared rays (between 7.75 and 1.5 microns), middle infrared rays (between 1.5 and 5.6 microns), and far infrared rays (between 5.6 and 1,000 microns) according to their energies carried.

Generally, infrared rays radiated from heaters, firebrands, or electric cookers almost belong to near infrared rays which produce a large quantity of thermal effects for short wavelength resulting in burn on skin and pathological changes in the crystal balls of eyes under long-time radiation. People often utilize infrared apparatuses to warm themselves during sleeping. However, some may radiate a large quantity of near infrared rays causing high heat energy on human bodies per hour. In addition, the sensibility of pain and temperature on skin becomes insensitive during sleeping, thus burn on skin often appears.

In contrast, with near infrared rays, far infrared rays will not result in burn on skin due to their long wavelengths and relative low energy. Other electromagnetic waves, such as ultraviolet rays, X rays, or gamma rays, will cause electrons to dissociate from atoms. However, far infrared rays will not.

Far infrared rays also differ from electromagnetic waves of low frequency (60 Hz) generated from household appliances. Though electromagnetic waves of low frequency generated from household appliances don't result in dissociation of electrons, they have a strong penetrability and will change the characteristics of currents in human bodies. Thus they are highly suspected as a serious factor to cancer. The case of far infrared rays is different. In fact, human bodies themselves radiate far infrared rays (9 microns). External far infrared rays only penetrate into skin to 0.1–0.1 centimeter.

In recent years, far infrared ray technologies are widely used in assistant treatment in many diseases such as ache in bones and muscles, myotenositis, bedsore, scald, and healing of wounds in Japan, Russia, Chinese Mainland and Taiwan region. And the assistant treatment is achieved by characteristic of speeding blood circulation of far infrared rays.

Thus, far infrared ray technologies have been used in military industries, household appliances, food processing and preservation and biochemistry industry, and have achieved quite good effects. Far infrared products not only have multiple functions, but also have small space occupied and low cost.

Take a case that far infrared ray is used in household appliances, our homes have been filled with various "so-called" far infrared products such as far infrared ceramic heaters, far infrared electro-thermal tubes and electrical heater made of radiators. There is no doubt that conventional far infrared electrical heaters can provide heat, but they are usually used in winter, which lasts less than 4 months. In other seasons, these products will be on the shelf. Therefore, conventional electrical heaters can't keep up with the trend of modern society in view of multiple functions of commodities.

SUMMARY OF THE INVENTION

With years of experience in design and manufacturing of commodities, and in order to solve above problems, the present inventor invented a frame structure with far infrared heating function.

The first object of the present invention is to provide a frame structure with far infrared heating function, wherein the frame structure combines a common fresco and a far infrared heating device to provide not only the indoor decoration function but also an electro-thermal function in cold winter.

Therefore, the, present invention discloses a frame structure with far infrared heating function, wherein a far infrared electro-thermal plate is mounted on the back of the canvas, and an energy chamber is mounted on the back of the canvas, and the energy chamber has a plurality of ventilation holes on its top and bottom rims to enable the air convection through said ventilation holes under the drive of heat generated from the electro-thermal plate and accumulated in the energy chamber to heat the room. Thus the fresco has double effects of both indoor decoration and electro-thermal heating.

BRIEF DESCRIPTION OF THE DRAWINGS

The following drawings are attached for illustration of preferred embodiment with the wish to further introduce its structure, features, functions and objects of this invention.

DETAILED DESCRIPTION OF PREFERRED EMBODIMENTS

A concrete embodiment of the present invention will be described in detail according to the accompanying drawings, and the structure, efficacy and object of the present invention will be further understood with specific reference to the drawings and descriptions.

Figure 1:
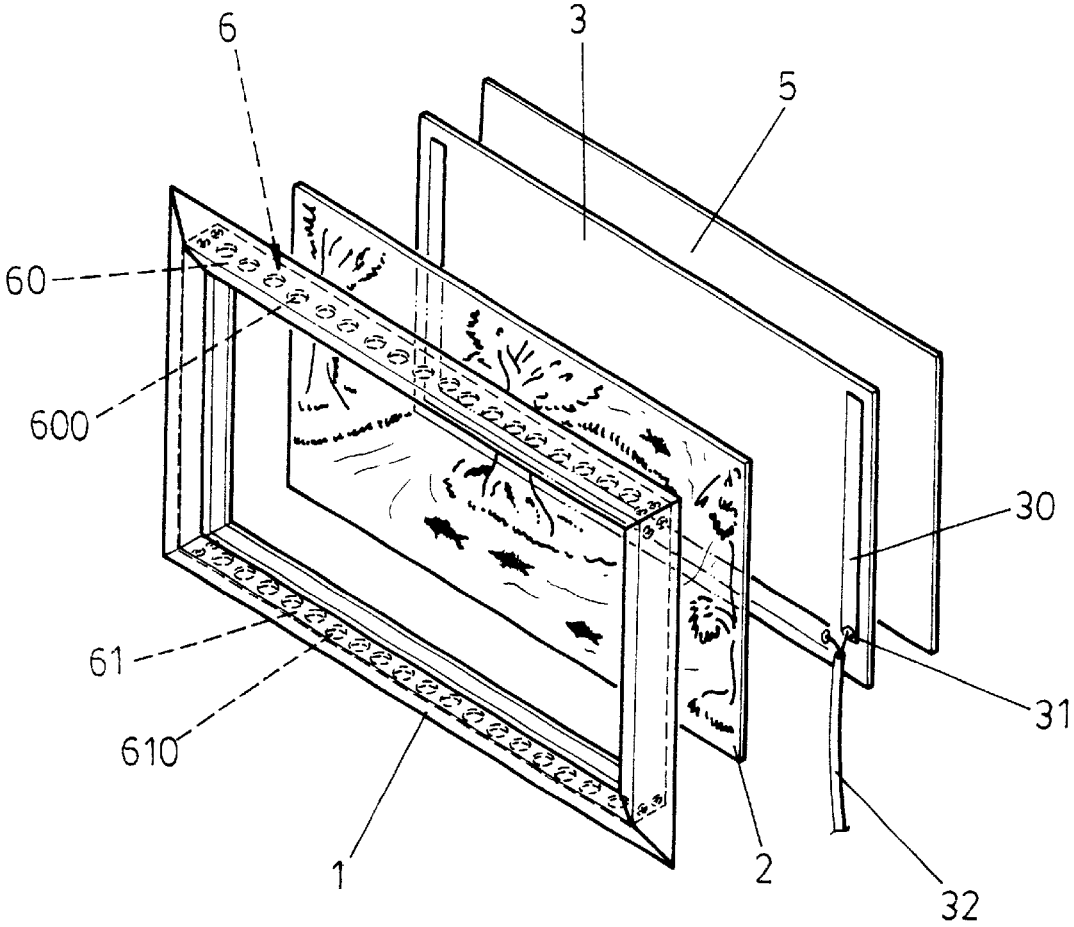
FIG. 1 is the exploded view of the present invention.
Figure 2:
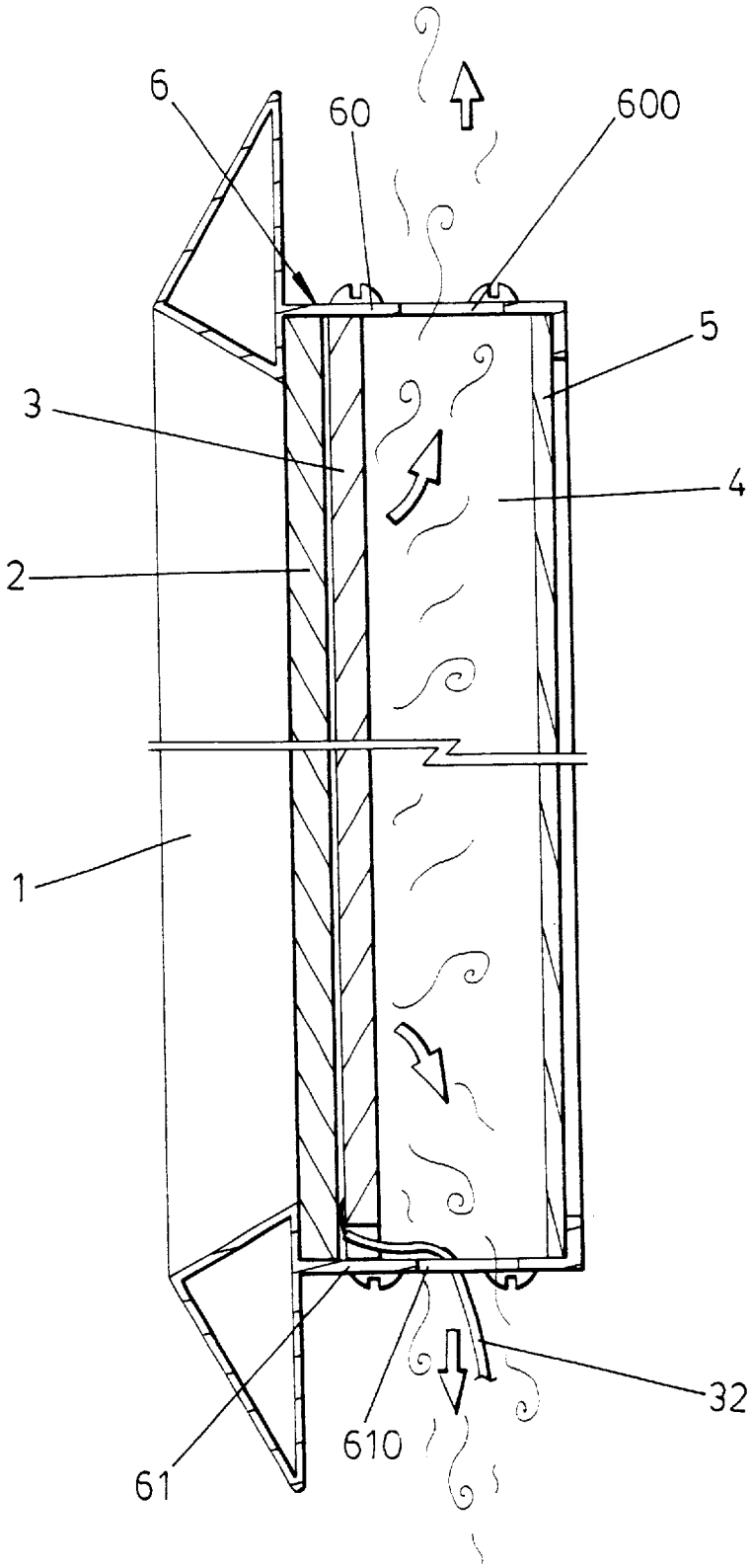
FIG. 2 is the sectional view of an embodiment of the present invention.

Referring to FIG. 1 and FIG. 2, the exploded view and the combined sectional view of the present invention respectively. A frame structure with far infrared heating function of the present invention comprises a frame body 1, a thematic canvas 2, a far infrared electro-thermal plate 3, an energy chamber 4, and a cover slab 5.

Thereof, the far infrared electro-thermal plate 3 is a compound processed electro-thermal device employing carbon fiber as conductive material. There is a conductive film 30 on the far infrared electro-thermal plate 3 and the electro-thermal plate is connected to external receptacle electrically via the conductive electrode 31 and the lead 32.

Thereof, the energy chamber 4 is a square box 6 extending backwards from the frame body 1, with the cover slab 5 to seal to form a space. There are a plurality of ventilation holes 600 and 610 on the top rim 60 and the bottom rim 61 of the square box 6 to enable the air convection through the ventilation holes under the drive of heat generated from the electro-thermal plate 3 and accumulated in the energy chamber 4 to heat the room.

The advantages and features of the present invention are:

1. The room temperature can rise quickly under heating and reaching desired temperature needs only 2 minutes.
2. No cold point, dirt, dry hot and noise.
3. Directly send heat to human body without any additional media and there is no cold radiation, therefore people can feel warm.
4. The wavelength of infrared rays is about between 8 and 15 microns, which has function of physical therapy such as activating body cells and facilitating metabolism.
5. No flame, magnetic pollution and risk of burn, also it has functions of dehumidifying, moisture-proof, antisepsis and fireproofing.
6. The electricity-to-heat conversion ratio is as high as 98%, saving 20%–30% than conventional heaters.
7. With temperature-sensitive switch, functions like constant temperature to power down are provided.

In conclusion, the present invention discloses a frame structure with far infrared heating functionality, wherein a far infrared electro-thermal plate is mounted on the back of the canvas, and an energy chamber extends backwards from the back of the frame, and the energy chamber has a plurality of ventilation holes on its top and bottom rims to enable the air convection through the ventilation holes under the drive of heat generated from the electro-thermal plate and accumulated in the energy chamber to heat the room. Thus the fresco has double effects of both indoor decoration and electro-thermal heating.

What is claimed is:

1. A frame structure with far infrared heating function, comprising a frame body, a thematic canvas, a far infrared electro-thermal plate, an energy chamber, and a cover slab; wherein the energy chamber is a square box extending backwards from the frame body, with the cover slab to seal to form a space, and there being a plurality of ventilation holes on the top and bottom rims of the square box.

2. A frame structure with far infrared heating function of claim 1, wherein the far infrared electro-thermal plate is a compound processed electro-thermal device employing carbon fiber as conductive material, a conductive film being provided to the far infrared electro-thermal plate, and the electro-thermal plate being connected to external receptacle electrically via the conductive electrode and the lead.

* * * * *